US008083987B2

(12) United States Patent
Schlienger et al.

(10) Patent No.: US 8,083,987 B2
(45) Date of Patent: Dec. 27, 2011

(54) BUOYANT PLUGS FOR LIQUID METAL CONTROL

(75) Inventors: Max Eric Schlienger, Napa, CA (US); Paul Anthony Withey, Derby (GB)

(73) Assignee: Rolls-Royce Corporation, Indianapolis, IN (US)

( * ) Notice: Subject to any disclaimer, the term of this patent is extended or adjusted under 35 U.S.C. 154(b) by 304 days.

(21) Appl. No.: 12/386,167

(22) Filed: Apr. 14, 2009

(65) Prior Publication Data

US 2009/0255963 A1 Oct. 15, 2009

Related U.S. Application Data

(60) Provisional application No. 61/124,045, filed on Apr. 14, 2008.

(51) Int. Cl.
*B22D 37/00* (2006.01)

(52) U.S. Cl. ..... 266/45; 222/590

(58) Field of Classification Search ..... 266/45, 266/236; 222/590

See application file for complete search history.

(56) References Cited

U.S. PATENT DOCUMENTS

| | | | |
|---|---|---|---|
| 2,127,239 | A | 8/1938 | Stoody |
| 2,618,477 | A | 11/1952 | Short |
| 2,710,128 | A | 6/1955 | Anderson |
| 3,032,841 | A | 5/1962 | Sylvester |
| 3,188,702 | A | 6/1965 | Smurthwaite |
| 3,201,837 | A | 8/1965 | Sylvester |
| 3,511,304 | A | 5/1970 | Baier et al. |
| 3,591,052 | A | 7/1971 | Nef |
| 3,682,458 | A | 8/1972 | Piwonka et al. |
| 3,830,281 | A | 8/1974 | Snider |
| 4,399,986 | A | 8/1983 | Collins |
| 4,462,574 | A | 7/1984 | Keenan et al. |
| 4,494,734 | A | 1/1985 | LaBate et al. |
| 4,601,415 | A | 7/1986 | Koffron |
| 4,610,436 | A | 9/1986 | LaBate, II et al. |
| 4,725,045 | A | 2/1988 | Cutre et al. |
| 4,968,007 | A | 11/1990 | Forte et al. |
| 5,249,780 | A | 10/1993 | Forte et al. |
| 5,346,184 | A | 9/1994 | Ghosh |
| 2004/0145096 | A1 | 7/2004 | Moriarty et al. |
| 2004/0164466 | A1 | 8/2004 | Koffron et al. |
| 2009/0255963 | A1 * | 10/2009 | Schlienger et al. ..... 222/590 |

FOREIGN PATENT DOCUMENTS

WO PCT/US09/02323 4/2009

* cited by examiner

*Primary Examiner* — Scott Kastler
(74) *Attorney, Agent, or Firm* — Krieg DeVault LLP

(57) ABSTRACT

A method of initiating a pour of a liquid alloy comprises the steps of filling an interior of a crucible with a displacement plunger and the liquid alloy until a metal head of the liquid alloy exceeds a critical height. The crucible has a bottom pour opening with a plug inserted therein. The plug is configured to be buoyant within the liquid alloy when the liquid alloy is below the critical height. Pour is initiated by at least partially withdrawing the displacement plunger until the metal head drops below the critical height.

31 Claims, 2 Drawing Sheets

BUOYANT PLUGS FOR LIQUID METAL CONTROL

CROSS REFERENCE TO RELATED APPLICATIONS

The present application claims the benefit of U.S. Provisional Patent Application No. 61/124,045, filed Apr. 14, 2008, and is incorporated herein by reference.

FIELD OF THE INVENTION

This invention can be applied to the manufacture of cast components in which there is a requirement to control flow of metal into a casting mould.

BACKGROUND OF THE INVENTION

Currently the bottom pour crucible arrangement typically uses a metallic plug that melts shortly after the metal charge. A bottom pour system allows the molten metal to be removed from the bottom of the melt pool, thus minimizing the likelihood of any dross being entrained into the mould.

SUMMARY OF THE INVENTION

In one embodiment there is a method of initiating a pour of a liquid metal into a casting mould that comprises providing a crucible with an interior base having an opening closed by a plug. The plug is buoyant in the liquid metal having a metal head below a critical height. A displacement body is at least partially immersed in the liquid metal in the interior of the crucible so that the metal head is above the critical height. Pour is initiated by at least partially withdrawing the displacement body from the liquid metal until the metal head falls below the critical height.

In another embodiment there is a method of initiating a pour of a liquid alloy that comprises the steps of filling an interior of a crucible with a displacement plunger and the liquid alloy until a metal head of the liquid alloy exceeds a critical height. The crucible has a bottom pour opening with a plug inserted therein. The plug is configured to be buoyant within the liquid alloy when the liquid alloy is below the critical height. Pour is initiated by at least partially withdrawing the displacement plunger until the metal head drops below the critical height.

A number of refinements are contemplated with respect to each embodiment.

In one refinement the method further comprises superheating the liquid metal prior to initiating pour.

In another refinement the method further comprises melting the metal into the liquid state after positioning the displacement body in the interior of the crucible.

In another refinement the method further comprises melting the metal into the liquid state before positioning the displacement body in the interior of the crucible.

In another refinement the method further comprises completely withdrawing the displacement body from the liquid metal.

In another refinement the method further comprises completely withdrawing the displacement body from the interior of the crucible.

In another refinement the method further comprises wherein the plug provided with the crucible is ceramic.

In another refinement the method further comprises wherein the plug provided is made of alumina.

In another refinement the method further comprises wherein the displacement body is a ceramic bar.

In another refinement the method further comprises wherein the plug provided includes an extension passing through the opening in the base of the crucible.

In another refinement the method further comprises wherein the crucible and casting mould are moved closer to each other until the extension of the plug contacts the casting mould.

In another refinement the method further comprises restraining the plug while melting the metal until the metal head exceeds the critical height.

In another refinement the method further comprises the plug is restrained by a latch.

In another refinement the method further comprises disengaging the restraint from the plug after the metal head exceeds the critical height.

DETAILED DESCRIPTION OF THE PREFERRED EMBODIMENTS

Figure 1:
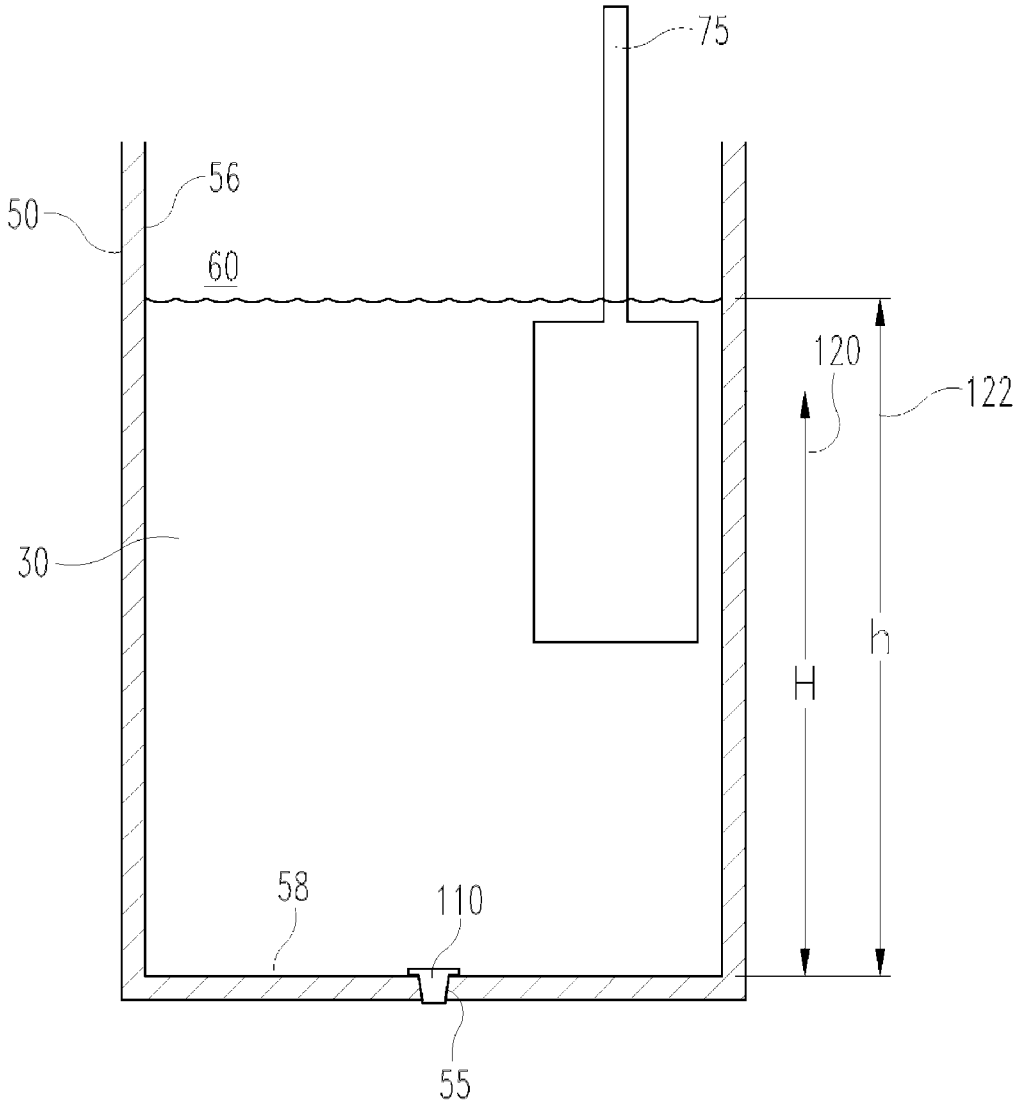
FIG. 1 is a cross sectional view of one embodiment of a bottom pour crucible having liquid metal therein with the buoyant plug retained in the bottom opening.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

This invention can be applied to control the flow of metal into a casting mould, and is especially useful in cases where it is necessary to superheat the alloy before pouring. A bottom pour crucible arrangement that uses a metallic plug that melts shortly after the metal charge does not allow the alloy to be superheated in a controllable manner.

In one embodiment of the present invention there is a buoyant plug to release molten alloy from a crucible into a casting mould at a defined and controllable time. The plug is preferably manufactured from a material that has a lower density than the alloy being poured (and/or is manufactured with one or more closed interior volumes). The plug is placed in an aperture in the base of the melting crucible. Although the plug would normally float in the molten alloy the pressure of the metal over the plug keeps it in place, thus blocking flow of the molten alloy through the aperture in the base of the crucible. Depending on the size of the plug, the size of the hole and the density difference between the alloy and the plug, there is a critical head height of alloy required to keep the plug in place. If the metal head height drops below this level, or the plug is displaced away from the hole, then the plug is able to float away, allowing the alloy to exit the crucible. This initiation event can be undertaken at any time, thus enabling the alloy to be superheated. Thus, the molten alloy may be contained inside the melting crucible until a particular set of conditions (such as superheating) are reached before the alloy is released into the mould. The buoyant plug arrangement does not rely on the melting of the plug, or the use of complex mechanical arrangements to contain the alloy.

One embodiment is to use a crucible with a hole in the bottom similar to the bottom pour crucibles in use for small bore furnace casting. The molten alloy is preferably retained in the crucible by a ceramic plug, manufactured from alumina for example, placed in the bottom of the crucible. The density of the plug is engineered so that a metal head greater than the critical head height keeps the plug in place during the superheating portion of the process. The head height in the crucible is allowed to fall when the preferred superheat is reached in the metal. One method of lowering the metal head below the critical head height is through the use of a movable displacement body that is at least partially immersed in the molten alloy. The displacement body might be, for example, a ceramic bar. The displacement body is at least partially, if not fully, withdrawn from the molten alloy (and might be completely removed from the interior of the crucible). This changes the amount of the load retaining the plug and it is possible to engineer the density of the plug sufficiently to allow it to be buoyant and float away. The molten alloy is now able to exit the crucible through the hole in the bottom of the crucible.

Figure 2:
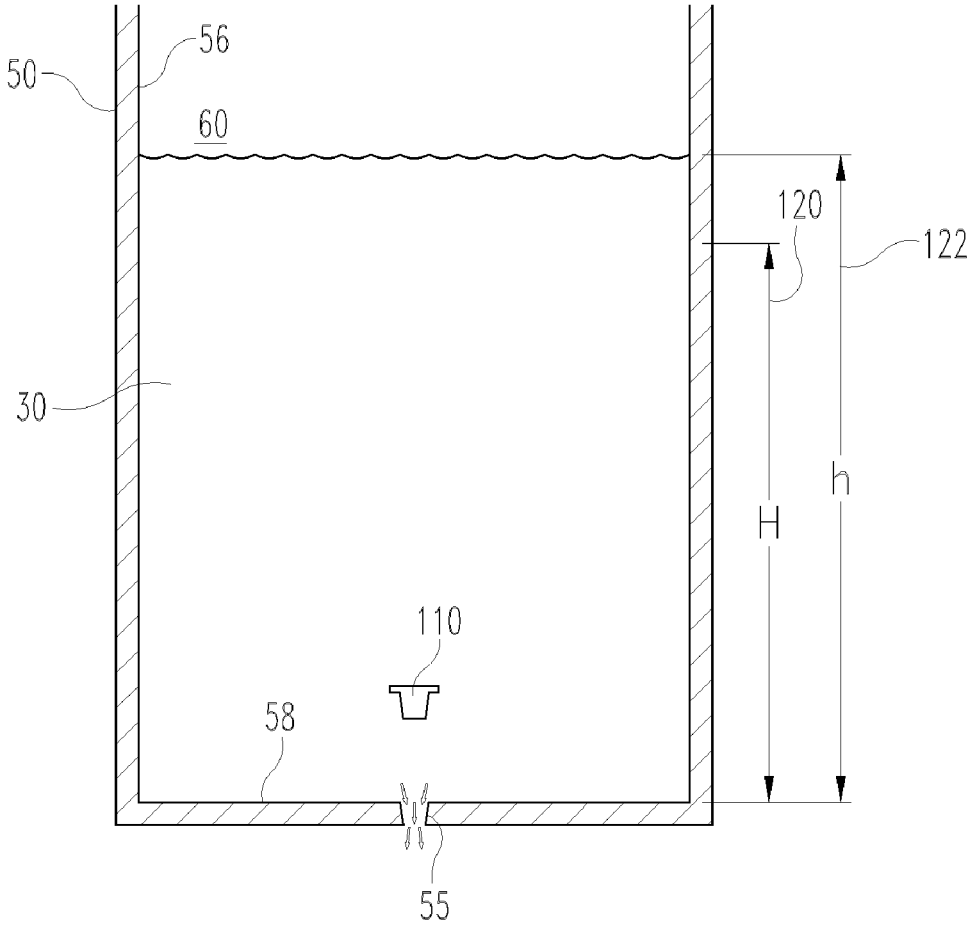
FIG. 2 is a cross section view of FIG. 1 after the displacement body has been withdrawn so that the metal head height is lowered below the critical height.

With reference to FIGS. 1 and 2, there is illustrated an embodiment of the present invention in which molten alloy 30 is retained within interior 60 defined by inner wall 56 of a crucible 50. While the present application will utilize the term alloy, it is defined to conclude super alloys and elemental metals unless specifically provided to the contrary. Crucible 50 is a bottom pour crucible that defines an opening 55 in the base 58. Molten alloy 30 is retained in the crucible 50 by a ceramic plug 110, manufactured from alumina for example, placed in the opening 55 in the base 58 of crucible 50. The density of the plug 110 is engineered so that a metal head "h" greater than the critical head height "H" keeps the plug 110 in place until the controlled initiation of pouring is desired. In one refinement such pour is not initiated until a superheating condition exists in the molten alloy 30. One form of the present application contemplates that a quantity of un-melted metal is utilized to keep the ceramic plug 110 in place within the opening 55 until the required critical head height "H" of molten metal is provided in the crucible. The quantity of un-melted metal can be placed upon the ceramic plug 110 to keep the plug in the opening 55 until the head height of molten metal has taken over holding the plug in a closed position. In another aspect the present application contemplates mechanical mechanisms for latching and/or holding the ceramic plug 110 in a closed position until the desired critical head height "H" of molten metal is accumulated.

With reference to FIG. 1 there is illustrated a displacement body 75 that is immersed in the molten alloy 30 within crucible 50. Displacement body 75 occupies a volume such that the metal head "h" is a height 122 that is greater than the critical head height "H" 120 necessary to retain the plug 110 within the aperture 55 in the base 58. At some later point in time, pour is initiated by at least partially withdrawing the displacement body 75 from the molten alloy 30 as illustrated in FIG. 2. The metal head "h" is a height 118 less than the critical head height "H" 120. Thus, buoyant plug 110 floats free and molten alloy exits via orifice 55 in the base 58 of crucible 50.

It should be understood that the displacement body 75 is illustrated as having a paddle shaped cross section, but may take on any of a wide variety of shapes and sizes. While the displacement body 75 is illustrated as fully withdrawn from the interior 60 of the crucible 50 in FIG. 2, it should be understood that, depending on the fill level and the critical head height "H", the body 75 might only need to be partially withdrawn in order to drop the metal head below a height of "H". That is to say, it is contemplated that the displacement body 75 might still be partially immersed in the molten alloy 30 when the metal head "h" fall below the critical head height "H" to initiate pouring. Also, if preferred, the crucible 50 might have a closed and/or pressurized interior.

In another embodiment of a bottom pour crucible system the buoyant (preferably ceramic) plug is modified. The plug includes a stem that extends through the hole and further extends beneath the base of the crucible. At the desired pour time the ceramic mould that receives the molten metal is elevated to contact the plug extension and lift the plug into the crucible. The metal can then pour from the crucible into the mould. Alternatively, the mould might remain stationary and the crucible might be lowered until the stem contacts the mould and lifts the plug into the crucible.

The plug 110 and the corresponding seat in the opening 58 are contemplated herein as taking on a variety of sizes and shapes. In one form the plug is tapered and matches with a tapered seat in the opening 58. In another form the shape of the plug matches the shape of the seat in the opening. The present application is not limited to the fore mentioned shapes and also fully contemplates a mismatch between the shapes of the plug and the seat so as to lead to a sharp edge surface seal. In one non-limiting example the plug and the corresponding seat are tapered and the plug is relatively large in size in comparison to the size of the opening 58 for the discharge of molten metal. Upon reduction of the head height of molten metal the plug is displaced from the seat and the annular area between the tapered surface of the plug and its tapered seat becomes of a size greater than the pouring orifice, the primary pressure drop shifts to the pouring orifice and the plug floats away from the seat.

It should be understood that in all of the embodiments described and/or illustrated herein the bottom pour opening might be centered in the base of the crucible or might be offset from the center of the base. Additionally, it should be further understood that the crucible might be any of a variety of shapes and cross-sections.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A method of initiating a pour of a liquid metal into a casting mould comprising:

providing a crucible with an interior base having an opening closed by a plug, wherein the plug is buoyant in the liquid metal having a metal head below a critical height;

at least partially immersing a displacement body in the liquid metal in the interior of the crucible so that the metal head is above the critical height; and, initiating pour of the liquid metal by at least partially withdrawing the displacement body from the liquid metal until the metal head falls below the critical height.

2. The method claim 1, further comprising superheating the liquid metal prior to initiating pour.

3. The method of claim 1, further comprising melting the metal into the liquid state after positioning the displacement body in the interior of the crucible.

4. The method of claim 1, further comprising melting the metal into the liquid state before positioning the displacement body in the interior of the crucible.

5. The method of claim 1, further comprising completely withdrawing the displacement body from the liquid metal.

6. The method of claim 5, further comprising completely withdrawing the displacement body from the interior of the crucible.

7. The method of claim 1, wherein the plug provided with the crucible is ceramic.

8. The method of claim 7, wherein the plug provided is made of alumina.

9. The method of claim 1, wherein the displacement body is a ceramic bar.

10. The method of claim 1, wherein the plug provided includes an extension passing through the opening in the base of the crucible.

11. The method of claim 10, wherein the crucible and casting mould are moved closer to each other until the extension of the plug contacts the casting mould.

12. The method of claim 3, further comprising restraining the plug while melting the metal until the metal head exceeds the critical height.

13. The method of claim 12, wherein the plug is restrained by a latch.

14. The method of claim 12, further comprising disengaging the restraint from the plug after the metal head exceeds the critical height.

15. The method of claim 12, wherein the plug is restrained by a quantity of un-melted metal.

16. The method of claim 12, wherein the plug has a tapered outer surface.

17. A method of initiating a pour of a liquid alloy comprising:

filling an interior of a crucible with a displacement plunger and the liquid alloy until a metal head of the liquid alloy exceeds a critical height, wherein the crucible has a bottom pour opening with a plug inserted therein and wherein the plug is configured to be buoyant within the liquid alloy when the liquid alloy is below the critical height; and, at least partially withdrawing the displacement plunger until the metal head drops below the critical height.

18. The method claim 17, further comprising superheating the liquid metal prior to initiating pour.

19. The method of claim 17, further comprising melting the metal into the liquid state after positioning the displacement plunger in the interior of the crucible.

20. The method of claim 17, further comprising melting the metal into the liquid state before positioning the displacement plunger in the interior of the crucible.

21. The method of claim 17, further comprising completely withdrawing the displacement plunger from the liquid metal.

22. The method of claim 21, further comprising completely withdrawing the displacement plunger from the interior of the crucible.

23. The method of claim 17, wherein the plug provided with the crucible is ceramic.

24. The method of claim 23, wherein the plug provided is made of alumina.

25. The method of claim 17, wherein the displacement plunger is a ceramic bar.

26. The method of claim 17, wherein the plug provided includes an extension passing through the opening in the base of the crucible.

27. The method of claim 26, wherein the crucible and casting mould are moved closer to each other until the extension of the plug contacts the casting mould.

28. The method of claim 19, further comprising restraining the plug while melting the metal until the metal head exceeds the critical height.

29. The method of claim 28, wherein said restraining is accomplished by a quantity of un-melted metal placed on the plug.

30. The method of claim 28, wherein the plug is restrained by a latch.

31. The method of claim 28, further comprising disengaging the restraint from the plug after the metal head exceeds the critical height.

* * * * *